United States Patent [19]

Diffely, Sr.

[11] Patent Number: 4,577,580

[45] Date of Patent: Mar. 25, 1986

[54] TROLLING ATTACHMENT FOR BOATS

[76] Inventor: Robert J. Diffely, Sr., P.O. Box 79, Plaza, N. Dak. 58771

[21] Appl. No.: 528,050

[22] Filed: Aug. 31, 1983

[51] Int. Cl.[4] ..... B63B 1/16

[52] U.S. Cl. ..... 114/285; 114/145 A; 403/95; 16/259

[58] Field of Search ..... 244/76 B; 114/145 R, 114/145 A, 285, 286, 287; 267/158; 403/92, 93, 95, 96; 16/257, 258, 259, 232; 74/100 P, 97

[56] References Cited

U.S. PATENT DOCUMENTS

| | | | |
|---|---|---|---|
| 2,230,958 | 2/1941 | Langdon | 114/145 A |
| 2,772,086 | 11/1956 | Foster | 267/158 |
| 2,807,228 | 9/1957 | Vandre | 114/285 |
| 3,001,499 | 9/1961 | Jacobs et al. | 114/285 |
| 3,371,641 | 3/1968 | Rohman et al. | 440/63 |
| 3,530,816 | 9/1970 | Mitchell | 114/285 |
| 3,568,618 | 3/1971 | Bedford | 114/285 |
| 3,965,838 | 6/1976 | Uht | 114/145 A |

FOREIGN PATENT DOCUMENTS

| | | | |
|---|---|---|---|
| 285667 | 2/1928 | United Kingdom | 403/92 |

*Primary Examiner*—Trygve M. Blix
*Assistant Examiner*—Thomas J. Brahan
*Attorney, Agent, or Firm*—Harvey B. Jacobson

[57] ABSTRACT

A trolling attachment for motor boats comprises pivotal trolling flaps for securement to the transom of a boat so that the flaps may be lowered into and raised from the water as required. The flap are carried on a rectangular box-section tube with leaf springs disposed against the tube to provide resilient frictional resistance to movement of the flaps and positive location and retention of the flaps in the raised and lowered positions by engagement of the springs against adjacent surfaces of the tube respectively.

15 Claims, 5 Drawing Figures

Fig. 1
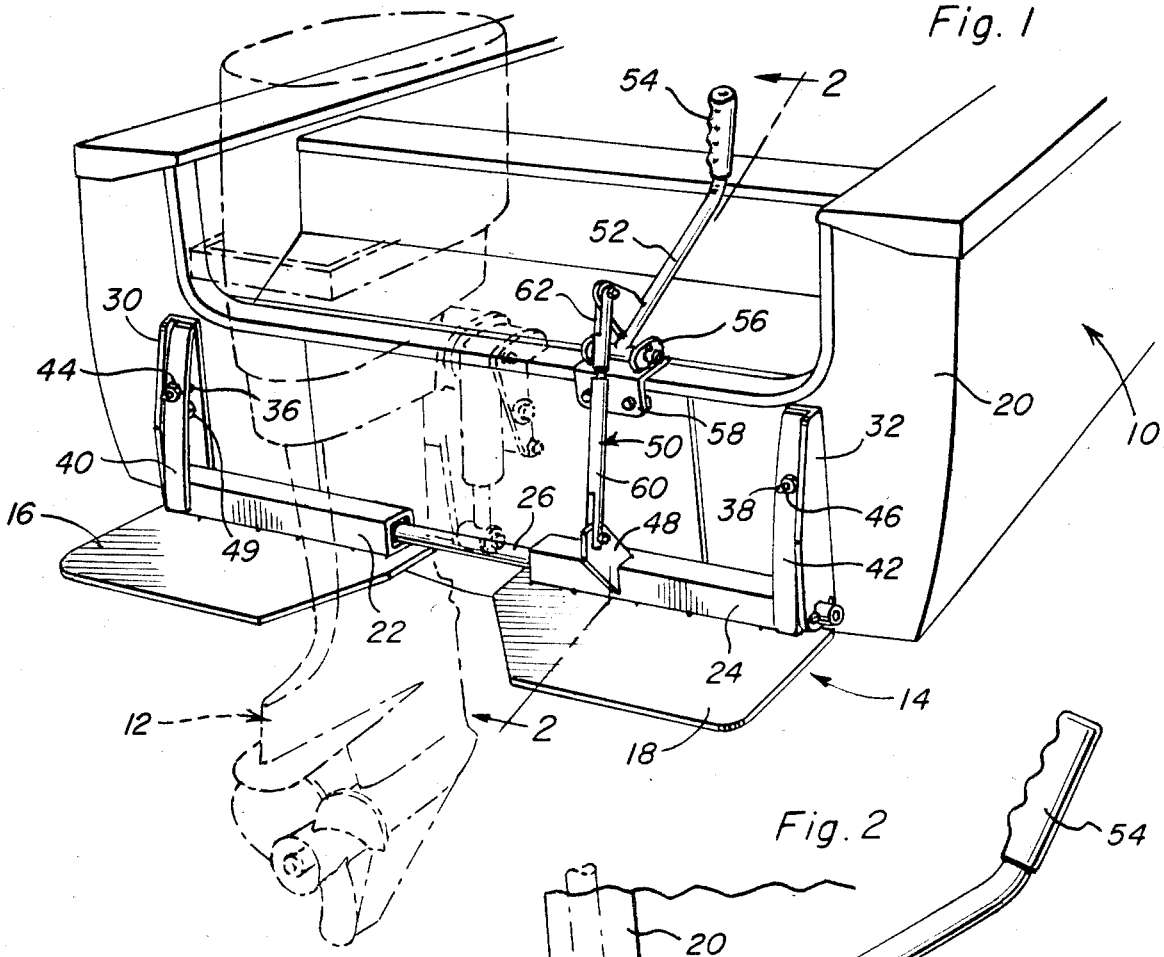
Fig. 2
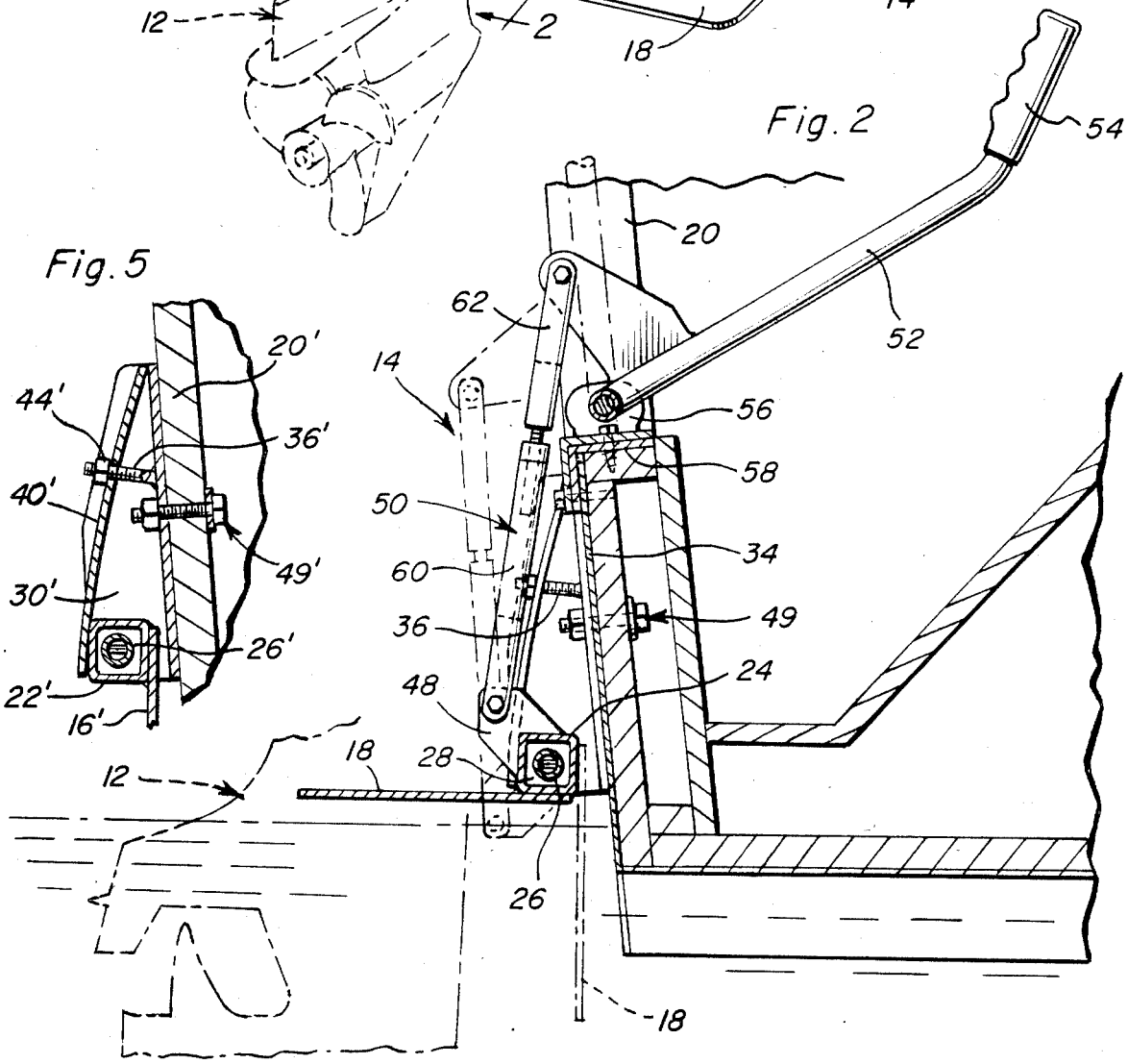
Fig. 5

TROLLING ATTACHMENT FOR BOATS

BACKGROUND OF THE INVENTION

It is well known to provide a motorboat of the outboard type or of the inboard-outboard type with a trolling attachment which enables the spped of the boat to be reduced sufficiently for trolling purposes, so that a boat which would otherwise be too powerful to operate at trolling speeds can be converted for such use. Trolling attachments commonly take the form of flaps secured to the transom of a boat for lowering into the water so as to produce drag effective to reduce the speed of the boat.

The present invention seeks to provide an improved trolling attachment including a pivotal flap which can be raised and lowered manually or automatically, which can be secured to a boat transom with securing means above the waterline, to reduce the possibility of leaks, which can be adapted to outboard or inboard-outboard type boats, and which has means for adjusting the force required to move the flap between raised and lowered positions.

STATEMENT OF PRIOR ART

Applicant acknowledges the following U.S. patents relating to trolling and like attachments for boats:

| | |
|---|---|
| 2,807,228 | 9/24/57 |
| 2,864,330 | 10/16/58 |
| 2,914,019 | 11/24/59 |
| 2,928,365 | 3/15/60 |
| 3,046,928 | 7/31/62 |

SUMMARY OF THE INVENTION

In accordance with the invention, a trolling attachment for a boat comprises a flap connected to a shaft, journal means for rotatably mounting the shaft on the transom of a boat, whereby rotation of the shaft enables the flap to be lowered into and raised from water in which the boat operates, and control means for providing resistance to movement of the flap between respective raised and lowered positions, and positive location and retention of the flap in each of said positions. Preferably, the control means may comprise a collar or the like on the shaft having adjacent angularly displaced outer surfaces, and friction means, which may be in the form of a leaf spring, which fits against the collar to provide frictional resistance to rotation of the shaft between said positions with positive engagement of the friction means against one or the other of said surfaces to position and retain the flap respectively in lowered position in the water or raised position out of the water.

The collar may, for example, comprise a rectangular section tube to which the flap may be secured, so that the flap is adapted to move through 90° between a raised horizontal position clear of the waterline, and a lowered vertical position in the water, with the friction means engaging adjacent surfaces of the tube in the respective raised and lowered positions of the flap. Additionally, where the friction means comprises a leaf spring, for example, adjustment means may be provided for altering the tension of the spring against the respective surfaces of the tube, so as to vary the force required to raise and lower the flap. An operating lever may be provided for manually raising and lowering the flap, but the construction of the attachment may be such that the flap will be raised automatically by suitably speeding up the boat, and such that it will be lowered automatically by suitably reversing the boat. Conveniently, the flap and its mounting means may be replicated on the port and starboard sides of a boat's propeller, and different versions of the attachment may be provided for outboard type boats and for inboard-outboard type boats.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the stern of an outboard type motorboat equipped with a trolling attachment in accordance with the invention.

FIG. 2 is a sectional view on line 2—2 of FIG. 1.

FIG. 5 is a sectional view on line 5—5 of FIG. 4.

DESCRIPTION OF THE PREFERRED EMBODIMENTS

Figure 3:
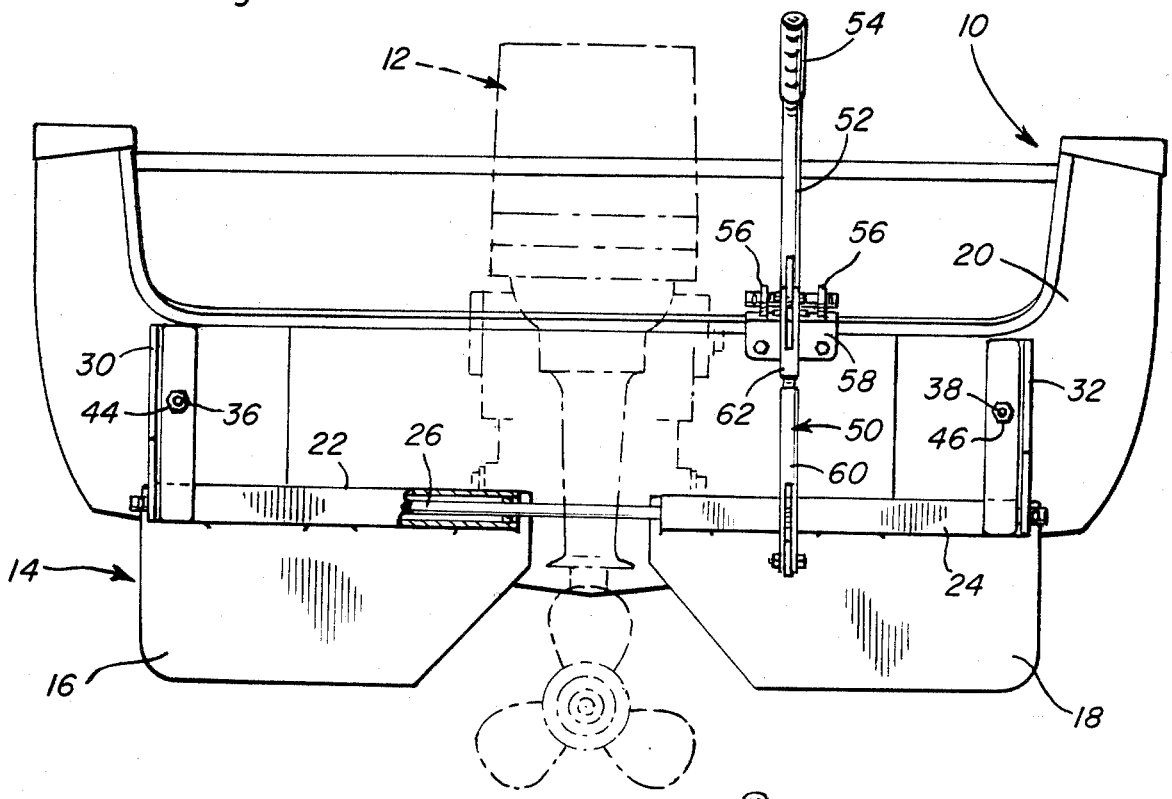
FIG. 3 is a rear elevational view of the apparatus shown in FIG. 1, with the trolling attachment shown in operative position.

Referring initially to FIGS. 1–3, there is illustrated a conventional form of motorboat 10 fitted with an outboard motor 12 (shown in dotted line) and a trolling attachment, generally indicated at 14, which may be used to reduce the speed of the boat, when required, to that suitable for trolling, so that the boat can be used by fishermen even though motor 12 may oridinarily be too powerful to run the boat at trolling speeds.

Basically, attachment 14 comprises a pair of trolling flaps 16 and 18 formed of metal plate or the like, and which are pivotally mounted on transom 20 of the boat to port and starboard of the motor, so that the flaps may be lowered into the water to provide a brake when trolling speeds are required, and which at other times may be raised from the water.

The flaps 16 and 18 are welded to respective rectangular box-section tubes 22, 24 which in turn are welded to a common shaft 26, for example, by means of plates 28 (see FIG. 2) so that the tubes form shaft collars.

Opposite ends of the shaft are journaled in angle-section brakcets 30, 32 attached to transom 20 by bolt and nut connections 49. Holes for such connections are drilled through the transom above the water line and adhesive foam rubber 34 may be interposed between the brackets and the transom to minimize chemical interference therebetween. Flaps 16 and 18 may thus be rotated with shaft 26 between raised and lowered positions.

Brackets 30, 32 each have a protruding bolt 36 or 38 welded thereto, the bolts carrying respective leaf springs 40, 42, the lower ends of which bear against the respective tubes 22, 24 thereby providing frictional resistance to turning of the tubes and flaps. The configuration of the springs and tubes is such that the springs will engage against one or other of the adjacent tube surfaces to positively locate and retain the flaps either in a horizontal raised position (FIG. 1) of a vertical lowered position (FIG. 3) while providing resistance of the movement of the flaps between the respective positions.

Turning of shaft 26 in one or other direction accordingly causes the flaps to snap from one to the other of such positions by engagement of the springs with the respective adjacent tube surfaces. Further, the tension which the springs apply against the tubes can be adjusted by means of nuts 44, 46 threaded on bolts 36, 38 so that the force required to move the flaps from one position to the other can be varied.

In order to provide a means for manually raising and lowering the flaps, tube 24 has an arm 48 welded thereto and connected by a pivotal link assembly 50 to a hand lever 52 having a handle 54. Lever 52 is journaled in supports 56 on a bracket 58 which is secured to the top of the transom. Link assembly 50 may comprise a pair of links 60, 62 with a threaded connection therebetween so that the length of the assembly can be adjusted in order to alter the angular disposition of the hand lever.

In the raised position, the flaps preferably clear the water line by about one inch. When it is required to use the boat for trolling, the flaps may either be lowered by means of the hand lever, or alternatively, the boat may be run in reverse to cause the wake from the motor to create a force on the flaps sufficient to lower them automatically. To raise the flaps, use can be made of the hadn lever, or the boat can be run forward at a speed sufficient to create the required lifting force on the flaps. In both raising and lowering the flaps, either manually or automatically, the spring and tube structures cause the flaps to snap from one position to the other position when the resistance of the springs is overcome.

Figure 4:
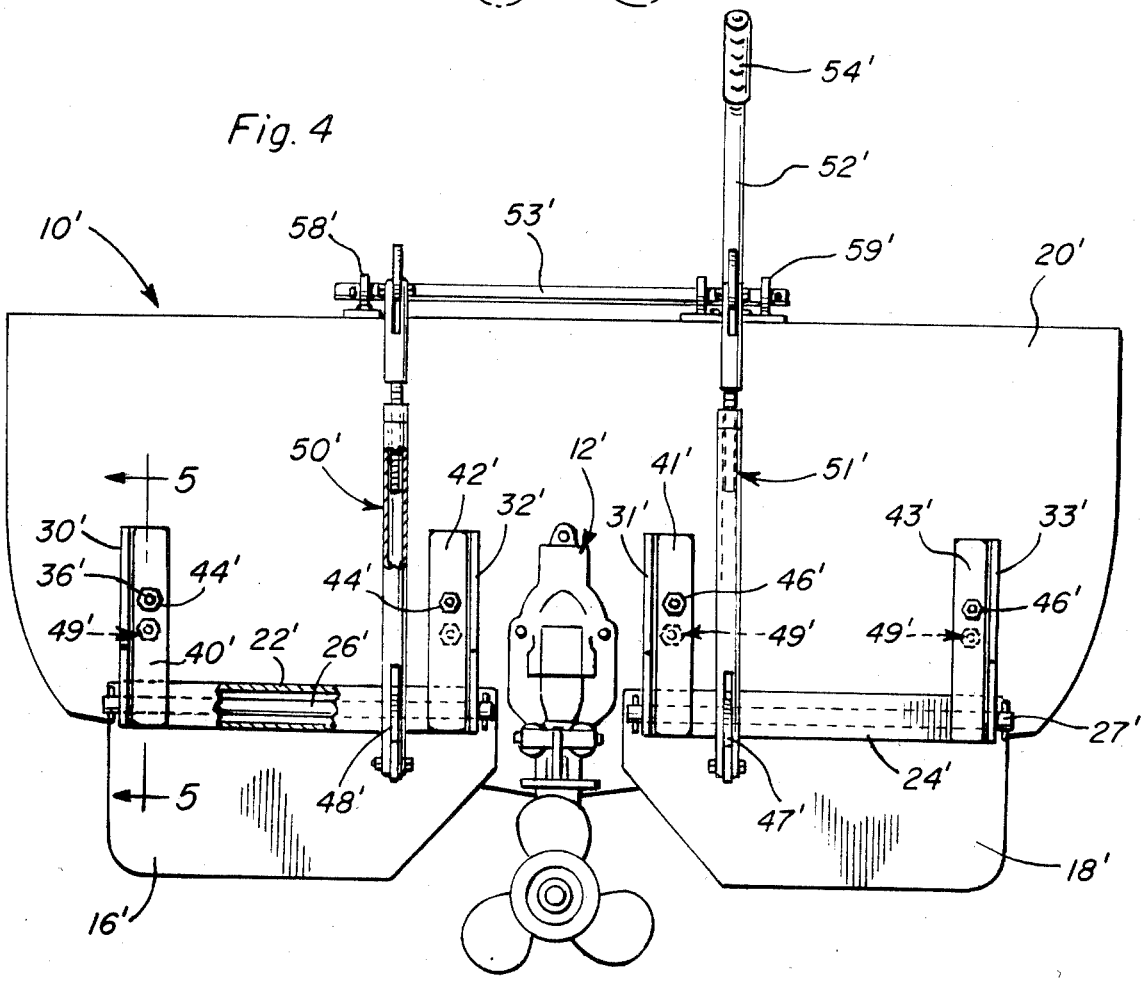
FIG. 4 is a view similar to FIG. 3 of a modified form of trolling attachment mounted on an inboard-outboard-type motorboat.

The structure shown in FIGS. 1–3 is suitable for outboard-type boats where the central section of shaft 26 can fit behind the vertical motor housing. For inboard-outboard-type boats, however, where this is not possible, an alternative structure as shown in FIGS. 4 and 5 may be used. In this case, flaps 16' and 18' and tubes 22', 24' are carried on separate shafts 26', 27' on opposite sides of the drive unit 12' with each mounted in angle-section brackets 30', 32' and 31', 33' with tension springs 40', 42', and 41', 43'. The tubes have welded arms 48', 47' each pivotally connected to an adjustable linkage assembly 50', 51', the linkage assemblies being connected to a hand lever 52' through a common shaft 53' journaled in brackets 58', 59' at the top of transom 20'. It will be appreciated that the trolling attachment shown in FIGS. 4 and 5 operates in the same manner as that described in relation to FIGS. 1–3.

It will be evident from the foregoing that the invention provides a trolling flap attachment suitable for use on outboard or inboard-outboard-type motorboats comprising trolling flaps which can be operated manually or automatically, which will automatically trip up when the speed of the boat is increased, without damage to the flaps, which clear the water line when the boat travels at high speed, and/or which allow forward or reverse trolling.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A trolling attachment for a motorboat comprising a trolling flap connected with a shaft, journal means for rotatably mounting the shaft on a transom of a boat so that rotation of the shaft enables the flap to be lowered into and raised from water in which the boat operates, a collar on the shaft having an outer surface with adjacent angularly displaced outer surface portions, an elongate leaf spring, and means for securing an upper end of the leaf spring to the transom with the lower end of the spring extending over the outside of and bearing against the outer surface of said collar to provide frictional resistance to rotation of the shaft between positions in which the spring engages respective ones of said surface portions, the flap being in raised position out of the water when the spring is in engagement with one of said surface portions and being in lowered position in the water when the spring is in engagement with the other of said surface portions, and the spring positively engaging one or other of said surface portions to provide positive location and retention of the flap in one or other of said positions, said collar comprising a rectangular box-section tube having one surface to which the flap is secured, and the spring is adapted to engage adjacent surfaces of the tube to locate the flap in the respective raised and lowered positions which are separated by 90° of shaft rotation.

2. The invention of claim 1 wherein the flap is disposed substantially horizontally above the low water line when in raised position, and substantially vertically when in lowered position.

3. A trolling attachment for a motorboat comprising a trolling flap connected with a shaft, journal means for rotatably mounting the shaft on a transom of a boat so that rotation of the shaft enables the flap to be lowered into and raised from water in which the boat operates, a collar on the shaft having an outer surface with adjacent angularly displaced outer surface portions, an elongate leaf spring, and means for securing the leaf spring to the transom with one end of the spring bearing against the outer surface of said collar to provide frictional resistance to rotation of the shaft between positions in which the spring engages respective ones of said surface portions, the flap being in raised position out of the water when the spring is in engagement with one of said surface portions and being in lowered position in the water when the spring is in engagement with the other of said surface portions, and the spring positively engaging one or other of said surface portions to provide positive location and retention of the flap in one or other of said positions, means for varying the tension with which the spring engages the outer surface of said collar so as to adjust the force required to move the flap between the raised and lowered positions, the means for securing the leaf spring to the transom including a protruding bolt extending through an opening in the spring and a nut engaging the free end of the bolt, the nut providing said means for varying the tension of the spring.

4. The invention of claim 3 wherein the bolt extends from one limb of an angle-section bracket secured against the transom to prevent transfer of forces from the bolt to the transom and the other limb of the bracket provides a journal for one end of the shaft.

5. The invention of claim 3 wherein the flap is located for automatic movement from the lowered to the raised position responsive to accelerated forward movement of the boat.

6. The invention of claim 3 wherein the flap is located for automatic movement from the raised to the lowered position responsive to reverse movement of the boat.

7. The invention of claim 3 including manually operable means for moving the flap between the raised and lowered positions.

8. The invention of claim 7 wherein the manually operable means comprises a pivotal hand lever, means for mounting said hand lever on top of the transom, and linkage means between the hand lever and said shaft for providing rotational movement of the shaft responsive to pivotal movement of the hand lever.

9. The invention of claim 8 wherein said linkage includes a link assembly which is adjustable for length so as to vary the operating position of the hand lever.

10. The invention of claim 3 wherein the flap is configured for location on one side of the boat's motor, and the attachment includes a further like flap collar and leaf spring for location on the other side of the motor.

11. The invention of claim 10 wherein said shaft is common to the flaps having a central section adapted to extend behind a vertical housing of an outboard motor.

12. The invention of claim 10 wherein the flaps are carried on separate shafts for location on the opposite sides of an inboard-outboard motor drive unit, and the shafts each have a linkage connected with a common hand lever mounted at the top of the transom.

13. A trolling attachment on a transom of a motorboat comprising shaft means, a pair of trolling flap assemblies on the shaft means each comprising a trolling flap connected to a rectangular section tube coaxially mounted on the shaft means, the trolling flap assemblies being spaced apart to accommodate the boat's motor therebetween, elongate brackets at respective ends of the shaft means rotatably attaching the shaft means to the transom and respective elongate leaf springs having upper ends attached to the transom above the shaft means and lower ends engaged over the outsides of the respective rectangular section tubes, the leaf springs resiliently engaging respective surface portions of the tubes for positively locating the flap assemblies in raised and lowered positions of the flaps determined by rotation of the shaft means.

14. The invention of claim 13 including tension adjusting means for each leaf spring comprising a threaded stud extending from the transom through a hole in the respective leaf spring intermediate its ends and a nut threaded on the stud engaging the outer surface of the leaf spring.

15. The invention of claim 13 including manually operable means for moving the flaps between said positions from within the motorboat.

* * * * *